US006966813B2

(12) United States Patent
Donahue

(10) Patent No.: US 6,966,813 B2
(45) Date of Patent: Nov. 22, 2005

(54) MODULAR CONSTRUCTION SYSTEM AND METHOD OF CONSTRUCTING TOY STRUCTURES

(76) Inventor: Joseph Donahue, 1204 Thomas Rd., Wayne, PA (US) 19087

( * ) Notice: Subject to any disclaimer, the term of this patent is extended or adjusted under 35 U.S.C. 154(b) by 0 days.

(21) Appl. No.: 10/438,308

(22) Filed: May 14, 2003

(65) Prior Publication Data

US 2004/0253901 A1 Dec. 16, 2004

(51) Int. Cl.[7] ..... A63H 33/04

(52) U.S. Cl. ..... 446/85; 446/126; 446/124; 403/217

(58) Field of Search ..... 446/102, 105, 446/107, 108, 119, 122, 126, 128, 124, 85; 403/217, 218, 353, 263, 252; 52/633, 645–646; 411/553, 349, 549

(56) References Cited

U.S. PATENT DOCUMENTS 3,355,820 A * 12/1967 Brumlik ..... 434/278
3,632,147 A * 1/1972 Finger ..... 403/171
3,902,270 A * 9/1975 Molenaar ..... 446/122
3,982,841 A * 9/1976 Endzweig ..... 403/19
4,927,287 A * 5/1990 Ohkawa et al. ..... 403/408.1
5,051,019 A * 9/1991 Kohl ..... 403/171
5,203,134 A * 4/1993 Sorenson et al. ..... 52/646
5,322,466 A * 6/1994 Bolli et al. ..... 446/121
5,328,286 A * 7/1994 Lee ..... 403/218
5,718,549 A * 2/1998 Noda et al. ..... 411/553
5,823,843 A * 10/1998 Pohlman ..... 446/120
6,345,946 B1 * 2/2002 Mainini et al. ..... 411/508
6,378,265 B1 * 4/2002 Konstandt ..... 52/655.2

* cited by examiner

*Primary Examiner*—Boyer D. Ashley
*Assistant Examiner*—J Williams
(74) *Attorney, Agent, or Firm*—National IP Rights Center, LLC

(57) ABSTRACT

A construction system and method of constructing is disclosed. The construction system includes a substantially spherical hub and linear member attached to the substantially spherical hub to construct a variety of structures. The method of constructing a structure utilizing a plurality of substantially spherical hubs and linear members includes inserting the linear members into the substantially spherical hubs and rotating them to lock them securely in place.

4 Claims, 9 Drawing Sheets

MODULAR CONSTRUCTION SYSTEM AND METHOD OF CONSTRUCTING TOY STRUCTURES

FIELD OF THE INVENTION

This invention relates to a toy modular construction system, and a method of constructing using the toy modular construction system.

BACKGROUND OF THE INVENTION

Children are filled with imagination and creativity. It is well known that encouraging this creativity is beneficial to the development of a healthy child. To this end, children's toys are often designed to be not only fun for children to play with, but also educational, thereby encouraging a child to be creative and learn as he plays.

One activity that children enjoy doing that also stimulates their creativity is constructing things such as pretend forts, playhouses, castles, spaceships, and many others. Since a child will use whatever is available to construct these things, it would be beneficial if there were a child's construction toy that was safe and easy for the child to use.

Accordingly, there are several types of children's construction toys out on the market. Many involve the use of a hub and member arrangement, wherein a child connects linear member pieces to a plurality of hub pieces in order to construct the structure that he wishes. In order to achieve a variety of structures, many of these construction sets utilize a variety of different hubs that allow various angles to be achieved, which can be challenging to a child to figure out which hub to use at which intersection of linear members. Others utilize a hub with multiple inserts that could be difficult for a child to manipulate.

For example, U.S. Pat. No. 6,402,581 discloses a hub and linear member system wherein the hubs are of varying types in order to achieve a variety of different directions and configurations. There are both elbow and tee hubs disclosed in the patent that a child would have to select in order to figure out how to build the particular structures he wishes.

U.S. Pat. No. 6,478,649 discloses another type of hub and linear member construction system. In this system, the arms are flexible and may be flexed either axially or laterally in order to create the desired structure. Also, the hubs disclosed have a variety of connecting surfaces to engage the arms, such as laterally expanding and contracting flexible loops, arms, coils, sleeves, cables, or spring-loaded forked arms.

U.S. Pat. No. 4,353,661 discloses a hub and linear member construction system having varying types of hubs depending on the particular radial direction that the constructor wants the linear members to extend. The linear members have holes punched in them which must be lined up with the holes on the hubs. A small key like locking device is then inserted to fasten the linear member to the hub.

It would therefore be beneficial if there were a child's modular construction set that would simplify construction for a child by having a uniform system of hubs and linear members that the child could employ. Not only that, but the construction set should be safe for a child to construct with a minimum of supervision.

OBJECTS AND SUMMARY OF THE INVENTION

In accordance with a first object of the present invention, there is provided a novel modular construction system. The construction system includes at least one substantially spherical hub having keyed openings and at least one linear member having keyed tabs, such that the linear member is inserted into the substantially spherical hub.

It is another object of the present invention to provide a novel construction system with a plurality of substantially spherical hubs and linear members. The plurality of substantially spherical hubs have keyed openings for receiving keyed tabs which are on the ends of the linear members to allow for easy attaching and detaching of the linear members to the substantially spherical hubs to construct various structures, such as forts, playhouses, castles, spaceships, and many other structures.

It is a further object of the present invention to provide a novel construction system that includes at least one substantially spherical hub half having keyed openings and at least one linear member having keyed tabs, such that the linear member is inserted into the substantially spherical hub half.

It is yet a further object of the present invention to provide a simple and safe method of constructing a structure utilizing a plurality of substantially spherical hubs and linear members. The linear members are inserted into the substantially spherical hubs and then rotated to lock them into place securely.

In accordance with a first aspect of the present invention, there is provided a modular construction system having at least one substantially spherical hub having at least one keyed opening and at least one linear member, having a first rotatable end and a second rotatable end, such that the first and second rotatable ends of the linear members are detachably connected to the at least one substantially spherical hub.

In accordance with another aspect of the present invention, there is provided a modular construction system having at least one substantially spherical hub half having at least one keyed opening and at least one linear member, having a first rotatable end and a second rotatable end, such that the first and second rotatable ends of the linear members are detachably connected to the at least one substantially spherical hub half.

In accordance with still another aspect of the present invention, there is provided a modular construction system having a plurality of substantially spherical hubs having a plurality of keyed inserts about the periphery of the substantially spherical hubs and a plurality of linear members, having a first rotatable end and a second rotatable end, the first and second rotatable ends adapted to be detachably connected to the plurality of keyed inserts about the periphery of the substantially spherical hubs such that the plurality of linear members may be connected in a plurality of positions.

In accordance with a further aspect of the present invention, there is provided a method of building a modular construction system, the modular construction system having a plurality of substantially spherical hub members having a plurality of keyed openings about the periphery, and a plurality of linear members, having a first and second end, comprising the steps of: attaching the first end of the linear member to a keyed opening of a first substantially spherical hub member; attaching the second end of the linear member to a keyed opening of a second substantially spherical hub member; and attaching additional linear members to additional substantially spherical hubs.

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE PRESENT INVENTION

Figure 1:
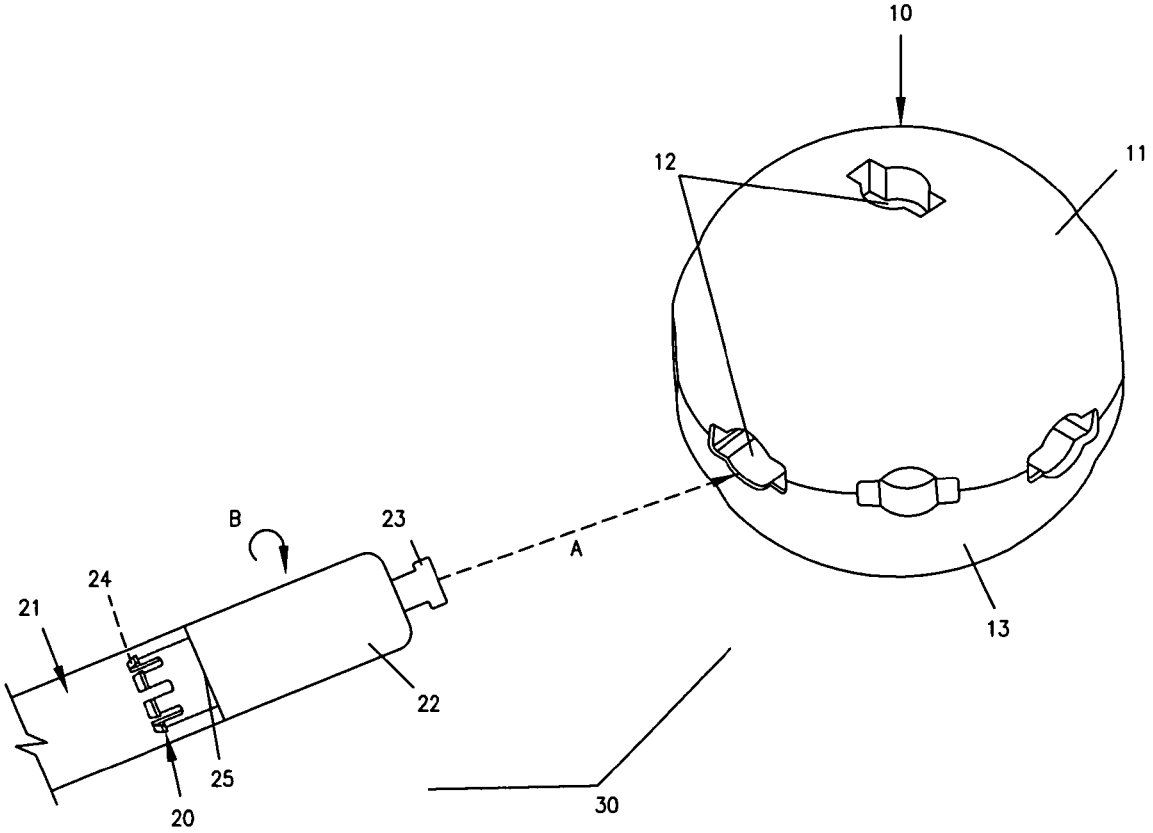
FIG. 1 is a perspective view of a substantially spherical hub and a linear member in accordance with a preferred embodiment of the present invention.

Referring now to the drawings, wherein like reference numerals refer to the same components across the several views, and in particular to FIG. 1, there is shown a modular construction system 30. Modular construction system 30 includes a substantially spherical hub 10, and a linear member 20. The substantially spherical hub 10 includes an upper half 11 and a substantially identical lower half 13 which are fastened together, and keyed openings 12 about the periphery of substantially spherical hub 10. The linear member 20 includes a sleeve 21 and an end piece 22 on either end 25 of the sleeve 20.

Figure 2:
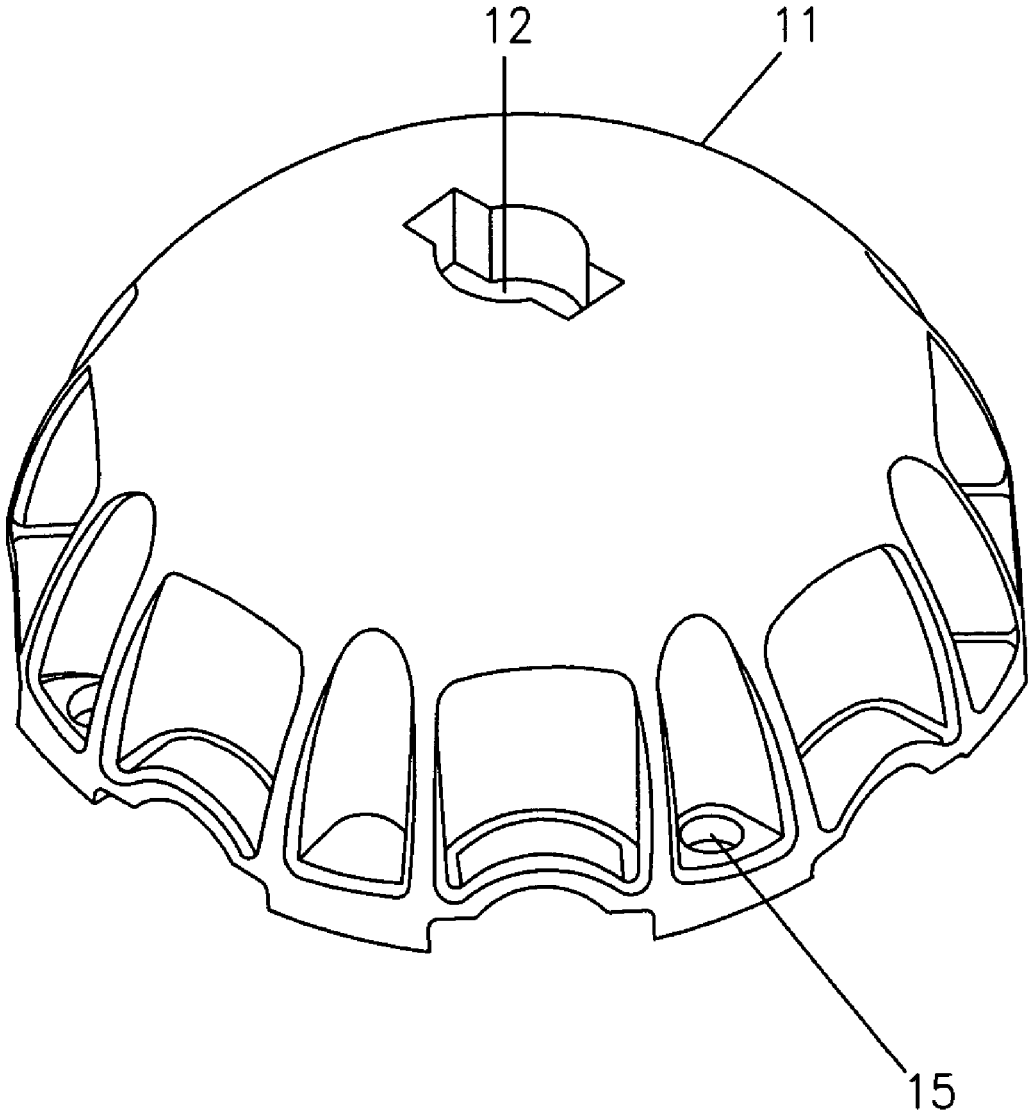
FIG. 2 is a perspective view of a top half section of the substantially spherical hub shown in FIG. 1.
Figure 3:
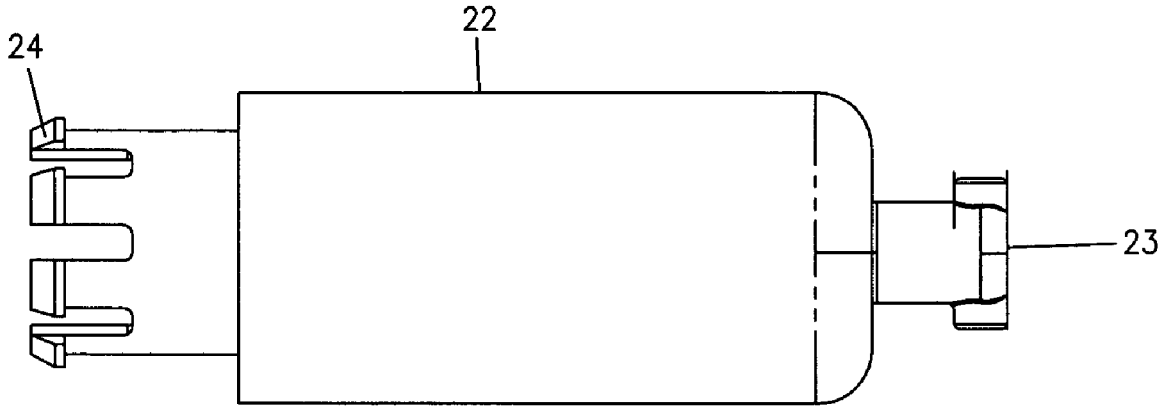
FIG. 3 is a side elevation view of an end piece of the linear member shown in FIG. 1.
Figure 4:
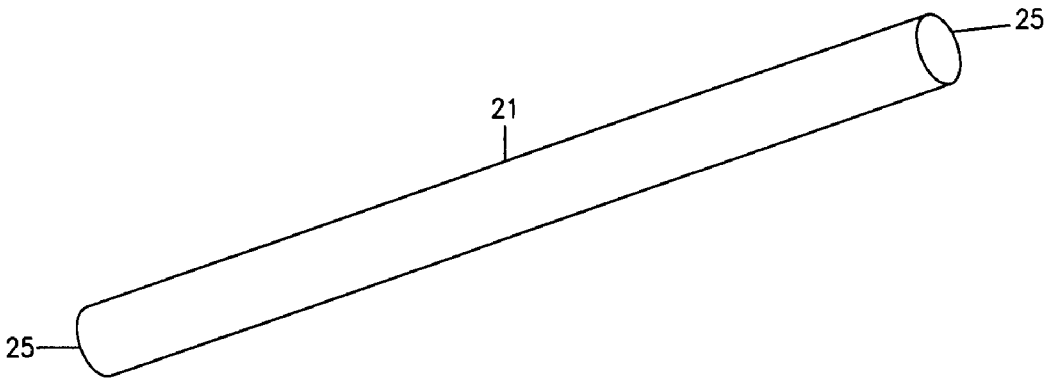
FIG. 4 is a perspective view of a sleeve of the linear member shown in FIG. 1.

Referring now to FIGS. 1 and 2, there is shown a substantially spherical hub 10, and an upper half 11 of the substantially spherical hub 10. The substantially spherical hub 10 may in fact be completely spherical, but may also take on other shapes, such as elliptical and oblong, among others. An identical lower half 13 will not be described as it is understood to be the substantially identical to upper half 11 of substantially spherical hub 10. The substantially spherical hub 10 is formed by fastening together the upper half 11 to the lower half 13 by means of fasteners inserted through fastener holes 15, which may be threaded to accept the insertion of a screw fastener. Any known means in the art of fastening upper half 11 to lower half 13 may be used, however, in a preferred embodiment of the invention the fasteners are screws. Around the periphery of substantially spherical hub 10 are a plurality of keyed openings 12, which are adapted to receive a keyed tab 23 on the end of linear member 20, so as to engage linear member 20 with the substantially spherical hub 10. The substantially spherical hub 10 may be formed out of many materials, including plastic, metal, and composites; however, in a preferred embodiment of the present invention, substantially spherical hub 10 is formed of plastic.

The linear member 20 will now be described with reference to FIGS. 1, 3, 4, 6 and 7. Linear member 20 includes a sleeve 21, an adapter 50 and an end piece 22 at either end 25 of linear member 20. The adapter 50 includes a face 51, an outer lip 52 and an inner lip 53. The adapter 50 is inserted into either end 25 of sleeve 21 and fixed inside of the sleeve 21 by, for example, sonic welding, or gluing. However, it can be readily seen by one of ordinary skill in the art that other means for fixing the adapter 50 inside of the sleeve 21 may be employed, such as friction. The end piece 22 includes a keyed tab 23 at one end and a series of tabs 24 at the other end. End piece 22 is inserted into either end 25 of sleeve 21 and held into place within sleeve 21 by tabs 24, which engage the inner lip 53 of the adapter 50. In this manner, the end piece 22 may rotate about its axis while remaining axially fixed to the sleeve 21. By this method, it is possible to use a variety of different colored sleeves 21 in modular construction system 30 in order to allow for a variety of pleasing configurations. On the end opposite to the one containing tabs 24 of end piece 22 there is a keyed tab 23 for insertion into keyed opening 12 on the substantially spherical hub 10 in order to attach the linear member 20 to the substantially spherical hub 10.

Figure 5:
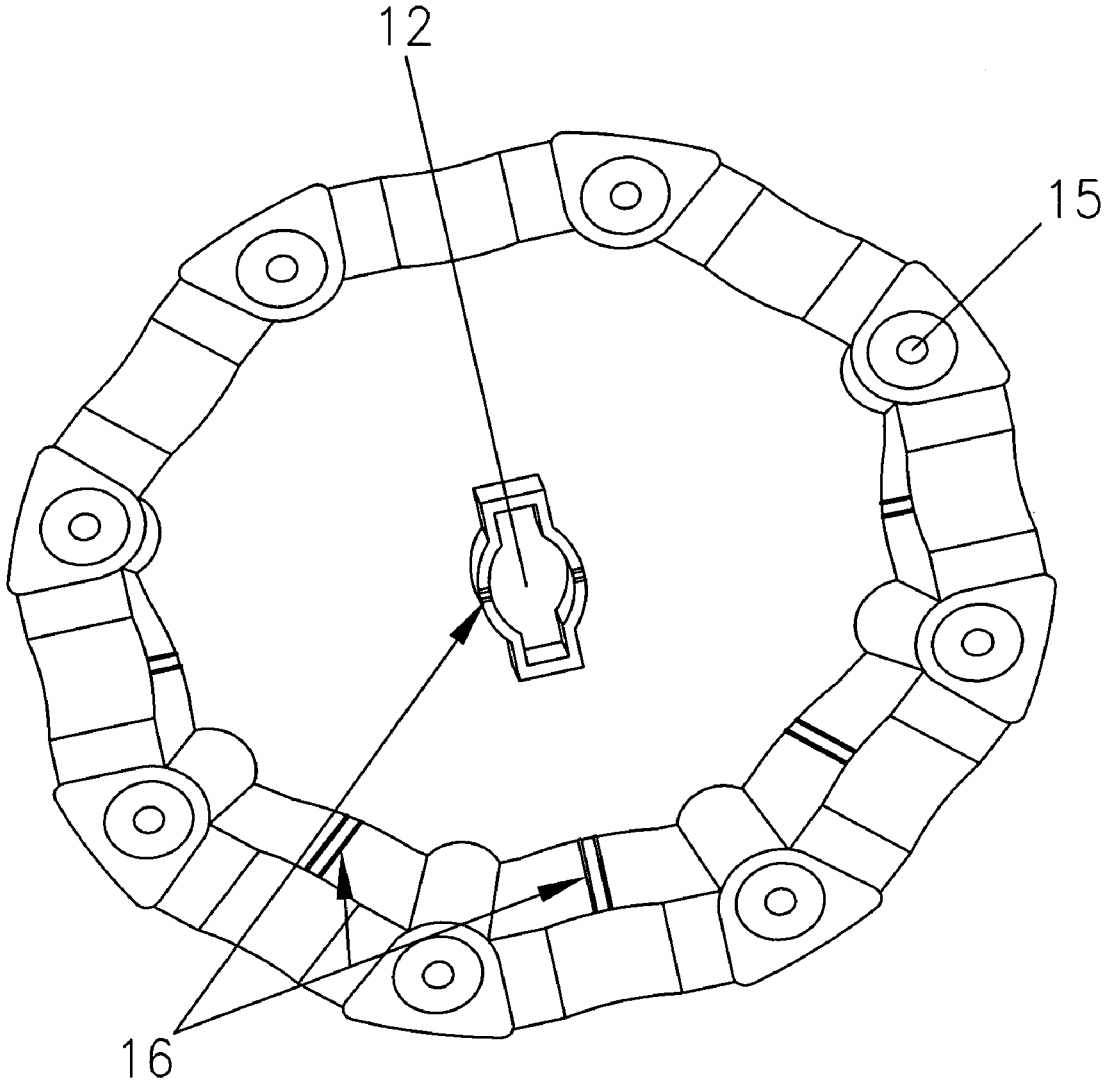
FIG. 5 is a perspective view of the underside of the substantially spherical hub shown in FIG. 1.
Figure 6:
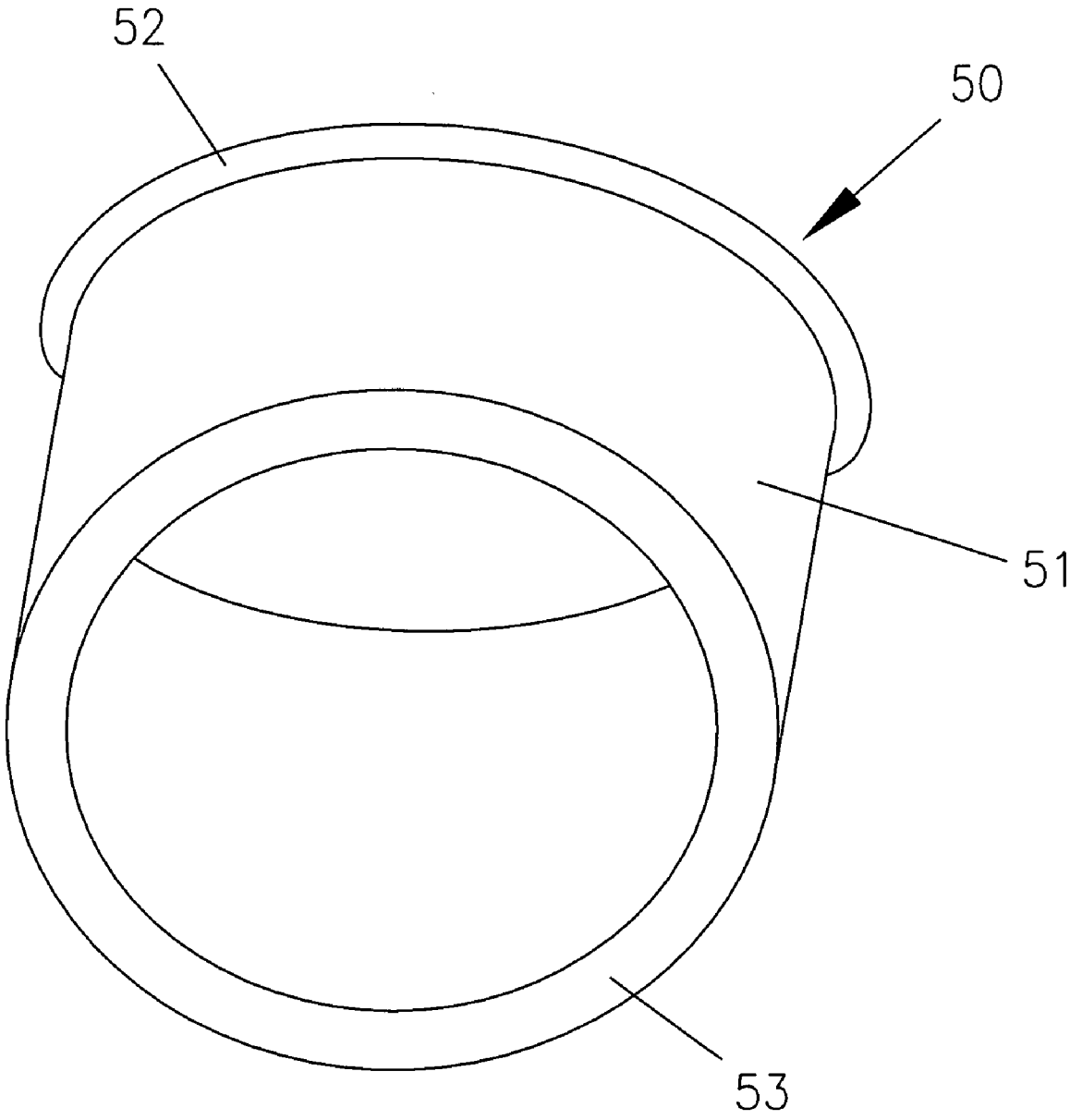
FIG. 6 is a perspective view of an adaptor in accordance with a preferred embodiment of the present invention.
Figure 7:
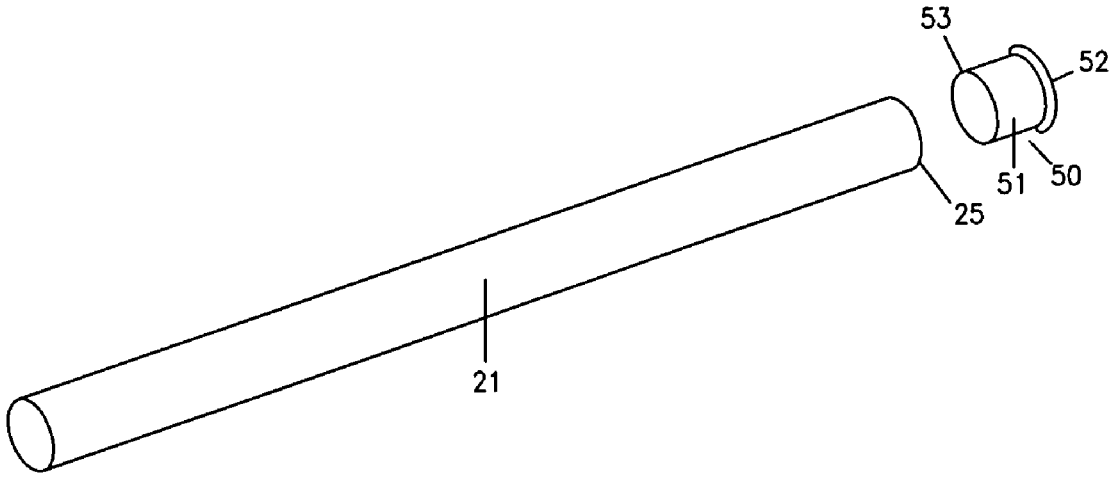
FIG. 7 is an exploded perspective view of the sleeve of the linear member and the adaptor assembly shown in FIGS. 4 and 6.

With reference now to FIG. 5, there is shown the underside of one-half of the substantially spherical hub 10. Formed into the underside of the substantially spherical hub 10 are ridges 16. The ridges 16 are formed proximate to the keyed openings 12 so as to engage the keyed tabs 23 of the linear members 20 and hold the linear members 20 in place.

Referring now to FIG. 1, a preferred method of utilizing the present invention can be seen. The linear member 20, including an end piece 22 at each end 25, is inserted into a keyed opening 12 around the periphery of the substantially spherical hub 10 along the direction of arrow 'A' such that the keyed tab 23 is fully inserted into the keyed opening 12 of substantially spherical hub 10. Linear member 20 can then be rotated axially in the direction of arrow 'B' or its converse to lock the keyed tab 23 into the keyed opening 12. Any amount of axial rotation will suffice that is greater than 0 degrees, but less than 180 degrees, but a preferred angle of rotation is 90 degrees to ensure a secure lock of linear member 20 into substantially spherical hub 10. This is a simple method of securing the linear member 20 to the substantially spherical hub 10 and is easily performed by a child who wishes to construct a structure. This process can be repeated with a plurality of linear members 20 and substantially spherical hubs 10 to achieve a variety of different structures, such as a fort, playhouse, castle, spaceship, and many others, by inserting the plurality of linear members 20 into the plurality of substantially spherical hubs 10 in a variety of directions.

Figure 9:
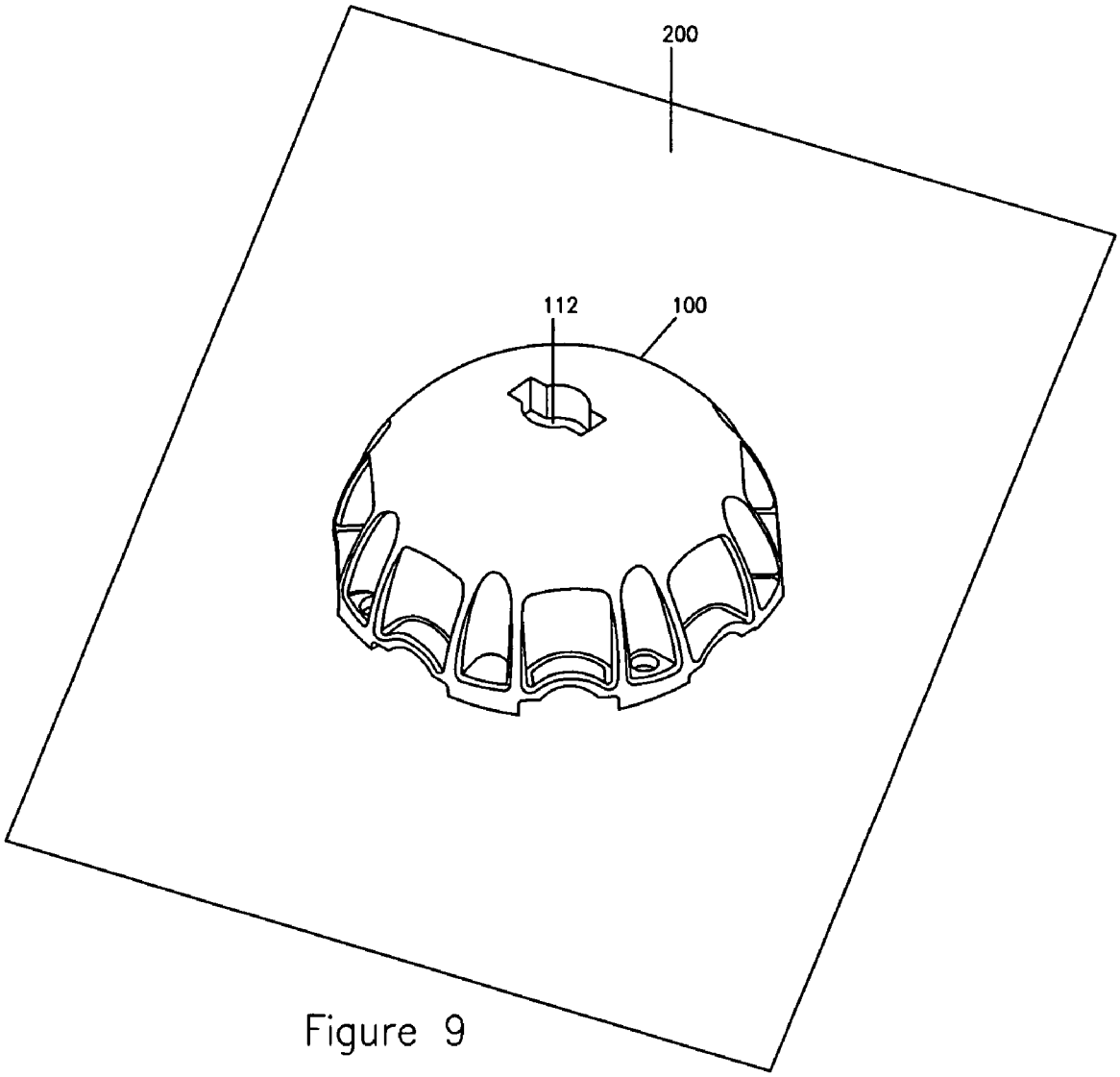
FIG. 9 is a perspective view of an alternative hub in accordance with the present invention.

Alternatively, only half of the substantially spherical hub 10 may be used in a given instance. For example, referring now to FIG. 9, a substantially spherical hub half 100 can be seen. The substantially spherical hub half 100 includes at least one keyed opening 112 on its periphery for receiving one of the keyed tabs 23 at the end 25 of linear member 20. In this manner, the substantially spherical hub half 100 can be situated on a planar surface 200, such as a floor, deck, or table. The present invention contemplates hub quarters, or other small sections as well.

Figure 8:
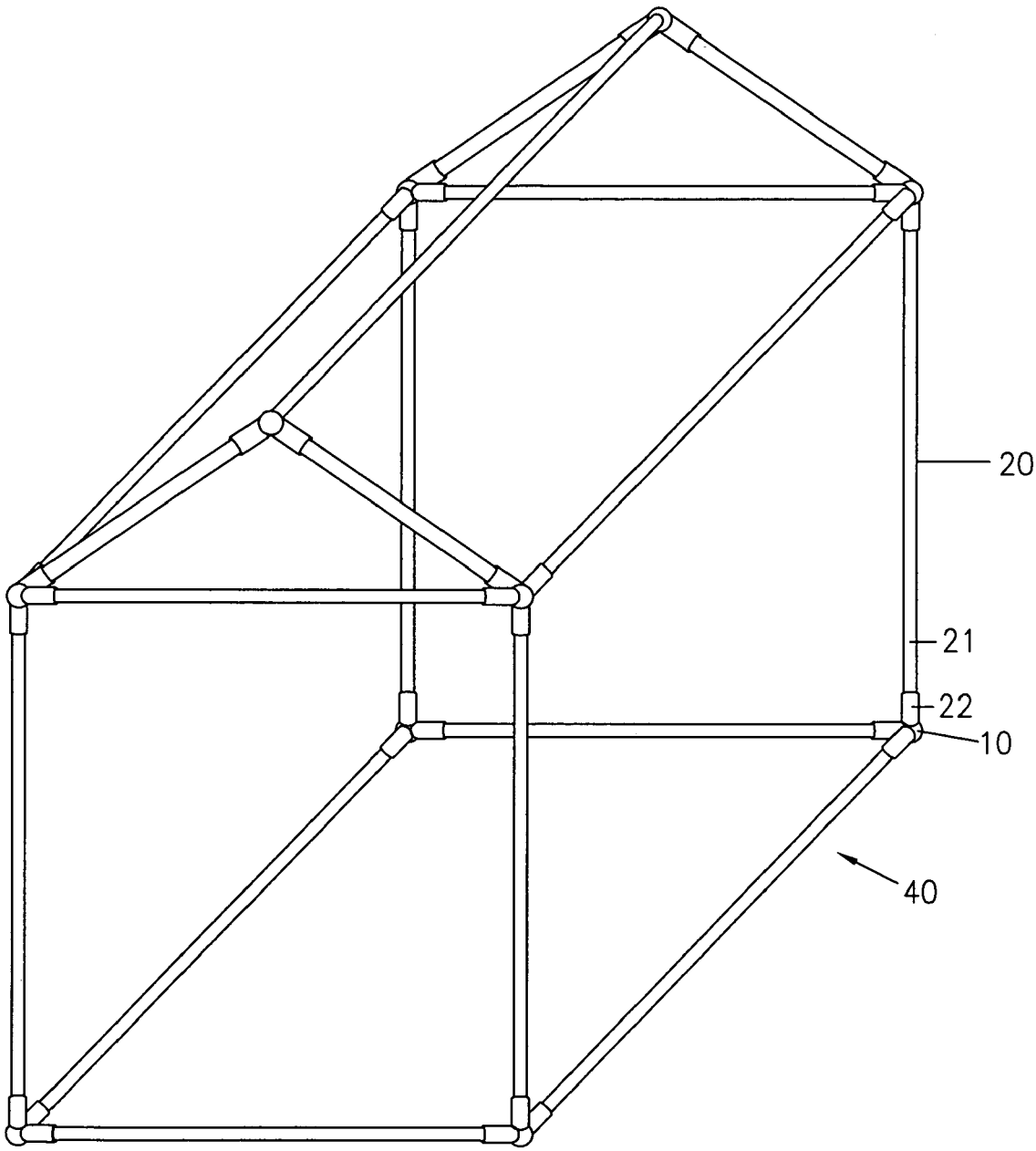
FIG. 8 is a perspective view of an assembled structure in accordance with the present invention.

Referring now to FIG. 8, one possible configuration of substantially spherical hubs 10 and linear members 20 can be seen. For example, the linear members 20 have been attached to the substantially spherical hubs 10 in such a way as to construct a playhouse 40. It is to be appreciated that the present invention may be used to construct a variety of additional objects.

In view of the foregoing disclosure, some of the advantages of the present invention are apparent. For instance, a modular construction system has been described that utilizes a uniform series of substantially spherical hubs and linear members wherein the linear members are inserted into the substantially spherical hubs to make a variety of structures. This uniformity in components will facilitate the construction of the structure by a child, and will stimulate his creativity, assuring him of an endless combination of structures to build. Furthermore, it provides a safe way for children to play while also learning at the same time.

While the preferred embodiments of the present invention have been described and illustrated, modifications may be made one of ordinary skill in the art without departing from the scope of the invention as defined in the appended claims.

What is claimed is:

1. A modular construction system, comprising:

at least one substantially spherical hub having a plurality of keyed openings;

at least one linear member, wherein the at least one linear member comprises a sleeve and an end piece, said sleeve comprising an adapter disposed within the end of the sleeve; and said end piece including a keyed tab adapted for insertion and rotatable locking into one of the plurality of keyed openings about the periphery of the at least one substantially spherical hub at one end, and a series of tabs mounted at the other end, for attaching the end piece to the adapter such that the end piece may rotate about its axis while remaining fixedly attached to the sleeve.

2. The construction system of claim 1, wherein the at least one substantially spherical hub comprises a substantially identical upper half and a lower half fastened together.

3. A modular construction system, comprising:

a plurality of substantially spherical hubs having a plurality of keyed openings about the periphery of the substantially spherical hubs; and a plurality of linear members, wherein the plurality of linear members each comprise a sleeve and an end piece, said sleeve comprising an adapter disposed within the end of the sleeve; and said end piece including a keyed tab adapted for insertion and rotatable locking into one of the plurality of keyed openings about the periphery of the at least one substantially spherical hub at one end, and a series of tabs mounted at the other end, for attaching the end piece to the adapter such that the end piece may rotate about its axis while remaining fixedly attached to the sleeve.

4. The construction system of claim 3, wherein the plurality of spherical hubs each comprise a substantially identical upper half and a lower half fastened together.

* * * * *